US008088238B2

(12) United States Patent
Hafner

(10) Patent No.: US 8,088,238 B2
(45) Date of Patent: Jan. 3, 2012

(54) DEVICE AND PROCESS FOR THE SPLICING OF LABEL BANDS

(75) Inventor: Dieter Hafner, Regensburg (DE)

(73) Assignee: Krones AG, Neutraubling (DE)

( * ) Notice: Subject to any disclaimer, the term of this patent is extended or adjusted under 35 U.S.C. 154(b) by 908 days.

(21) Appl. No.: 11/996,206

(22) PCT Filed: Jul. 4, 2006

(86) PCT No.: PCT/EP2006/006482

§ 371 (c)(1),
(2), (4) Date: May 9, 2008

(87) PCT Pub. No.: WO2007/009585

PCT Pub. Date: Jan. 25, 2007

(65) Prior Publication Data

US 2008/0196819 A1 Aug. 21, 2008

(30) Foreign Application Priority Data

Jul. 19, 2005 (DE) ..... 10 2005 033 486

(51) Int. Cl.
*B65H 21/00* (2006.01)
*B65H 69/06* (2006.01)

(52) U.S. Cl. ..... 156/159; 156/502; 156/504; 242/553; 242/556.1

(58) Field of Classification Search ..... 156/157, 156/159, 502, 504, 505; 242/551, 552, 553, 242/556.1
See application file for complete search history.

(56) References Cited

U.S. PATENT DOCUMENTS

| | | | | |
|---|---|---|---|---|
| 3,717,057 | A * | 2/1973 | Takimoto | 83/98 |
| 4,417,940 | A * | 11/1983 | Koster | 156/351 |
| 4,432,481 | A | 2/1984 | Miller | |
| 4,473,430 | A * | 9/1984 | Voltmer et al. | 156/504 |
| 4,555,281 | A | 11/1985 | Mattei et al. | |
| 5,152,858 | A * | 10/1992 | Winter | 156/157 |
| 6,792,987 | B2 | 9/2004 | Monroe | |
| 6,881,289 | B2 * | 4/2005 | Borderi et al. | 156/159 |

(Continued)

FOREIGN PATENT DOCUMENTS

DE 3119109 12/1982

(Continued)

OTHER PUBLICATIONS

International Preliminary Report on Patentability based on PCT/EP2006/006482; International Filing Date: Jul. 4, 2006; Date of Issuance: Feb. 20, 2008.

(Continued)

*Primary Examiner* — Mark A Osele
(74) *Attorney, Agent, or Firm* — Marshall, Gerstein & Borun LLP

(57) ABSTRACT

A process and a device for the splicing of label bands having a conveying device for the forward movement of a first forward label band and of a second trailing label band along a transport path, and a splicing station for exerting a splicing pressure during the transport. In order to ensure that the splicing can be carried out reliably and precisely, even at high band speeds there is provided within the transport path in front of the splicing station, a separating device for the formation of a defined end edge on the trailing end of the forward label band.

23 Claims, 2 Drawing Sheets

U.S. PATENT DOCUMENTS

Figure 1:
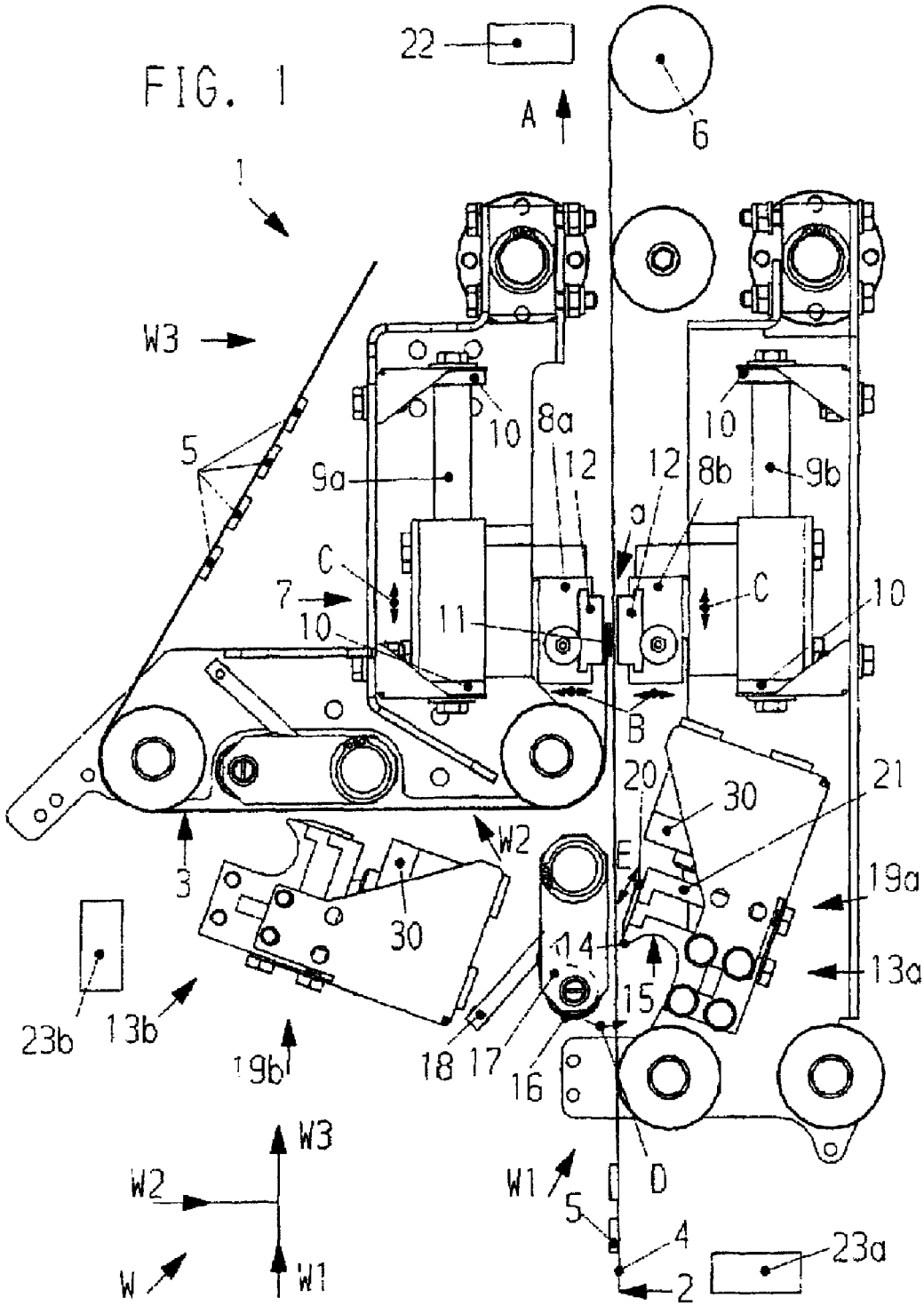

| | | | | |
|---|---|---|---|---|
| 2002/0189764 | A1* | 12/2002 | Keene et al. | 156/353 |
| 2006/0272763 | A1* | 12/2006 | Tiefel et al. | 156/157 |

FOREIGN PATENT DOCUMENTS

| | | |
|---|---|---|
| DE | 3438952 | 5/1985 |
| DE | 3923163 | 1/1991 |
| DE | 4002194 | 8/1991 |
| DE | 19529866 | 2/1997 |
| DE | 19731024 | 1/1999 |
| DE | 19818384 | 10/1999 |
| DE | 10146448 | 4/2003 |
| WO | WO-2007/009585 | 1/2007 |

OTHER PUBLICATIONS

Written Ruling of the International Research Authority (Supplemental Sheet) based on PCT/EP2006/006482; International Filing Date: Jul. 4, 2006.

* cited by examiner

DEVICE AND PROCESS FOR THE SPLICING OF LABEL BANDS

CROSS-REFERENCE TO RELATED APPLICATION

The present application claims the benefit of priority of International Patent Application No. PCT/EP2006/006483, filed on Jul. 4, 2006, which application claims priority of German Patent Application No. 10 2005 033486.5, filed Jul. 19, 2005. The entire text of the priority application is incorporated herein by reference in its entirety.

FIELD OF DISCLOSURE

The disclosure relates to a device and a process for the splicing of label bands, such as used for containers in bottling operations.

BACKGROUND

An ever recurring problem with labeling machines is the fact that label bands that have been used up must, to the extent possible, be connected with a new label band without a change in the production speed or the production parameters, as the case may be. A multiplicity of devices of this type are known. Thus, for example, DE-OS 195 29 866, which was taken into consideration in the formulation of the introductory portion, presents a splicing device with a multiplicity of rollers positioned opposite to one another. In particular, the splicing device contains an anvil roller and a pressure roller, which are located directly at the splicing point. The anvil roller and the pressure roller are positioned opposite one another on both sides of the label band, so that the label band passes between both of the rollers. The pressure roller can be moved in the direction of the anvil roller and can, in the short term, exert high pressure on the label band positioned between the two. Behind these two rollers, two pairs of forward-moving rollers are preferably provided, one of which is supported in a spring-mounted manner in every pair. In this case, too, the label band passes between the rollers of every pair. The spring-mounted forward-moving roller thereby continuously exerts a pressing force corresponding to the thickness of the label band, which can be controlled, as needed, on the stationary forward-moving roller of the same pair that is positioned opposite.

Each label band to be used in this splicing device must be equipped on its trailing end with a special adhesive layer and a signal transmitter that controls the splicing process; therefore, only special label bands are to be used. The transport path in front of the splicing device contains two branches that are used alternately to move the forward and the trailing label band forward. A label band is held in readiness in the specifically non-active branch of the transport path so that it can be attached to the trailing end of the forward, or old, label band both immediately and without interruption of the production. At least one label is removed from the new label band manually, and the beginning thus prepared is inserted into the splicing device applied to the pressure roller. If the approaching end of the old label band is now signaled by the signal transmitter on the trailing end of the old label band, then the label-free beginning of the new label band is pressed in the direction towards the adhesive on the end of the old label band as soon as this is positioned in the gap between the anvil roller and the pressure roller. The splicing point then passes through the forward-moving rollers, whereby an additional pressure is exerted on the splicing point by the overlapping spliced band areas. It is thereby not possible to prevent this pressure from also being exerted on the labels, which could make the subsequent detachment of the labels difficult. Furthermore, the known device requires very great care by the operator during the preparation and insertion of the trailing, or new, label band. It must be ensured, in any event, that the label-free beginning is positioned in such a manner that the entire adhesive area is positioned on the support band of the trailing label band after the splicing and does not protrude above the beginning edge or lie on top of a label, for example. On the other hand, however, the distance between the last label in front of the splicing point and the first label after the splicing point should not be too great. Furthermore, it is an additional complication that the label-free beginning must move together with the pressure roller in the direction towards the anvil roller, so that the operator must also take into account the time required for this movement, which can hardly be carried out manually, as well as the longer path that is necessary for it.

SUMMARY OF DISCLOSURE

The task that forms the basis for the disclosure is consequently that of preparing a device and a process for the splicing of label bands, by means of which label bands can be spliced precisely and at high speed without requiring a high degree of experience or manual effort.

By means of the configuration in accordance with the disclosure, a defined end edge and/or a defined splicing area is produced on the forward label band during the conveying of the forward label bands, the position of which can be determined and tracked precisely. The necessity of having to position a label band precisely in the transport path is thereby eliminated.

A precisely defined end edge of the forward label band, the distance of which from the splicing station is known, can be produced without manual labor by means of the separating device positioned in the transport path in front of the splicing station. Furthermore, the generally unusable last labels of a label band can be separated without additional manual effort being required for that purpose.

A label-free splicing area can be produced at a defined point in front of the label band without manual labor by means of the label-removing device positioned in the transport path in front of the splicing station.

The cutting of the end edge and/or the removal of the label for the formation of the splicing area is carried out by means of one of the conventional deflector edges, whereby, in accordance with the disclosure, a guide recess into which the label band can be pressed as soon as the band has to be separated and/or a label has to be detached is assigned to this deflector edge. By that means, the deflector edge can be put out of action during the forward movement in a constructionally simple manner, but can, however, still be immediately activated as soon as it is required.

If both the separating device and the label-removing device use the same deflector edge, then the control is simplified, since the mutual relationship of the devices to one another and to the deflector edge is fixed.

The use of a pressure roller supported on a swiveling lever for pressing the label band into the guide recess represents a possibility that is constructionally simple and influences the speed of conveyance as little as possible.

A reception surface for the label removed that is provided on the label-removing device represents a possibility for removing the detached label in a defined manner, without the danger that the label will adhere to undesirable points being present.

The reception surface is suitably connected with the swiveling lever in such a manner that both of them are jointly moved into their working position and can be swiveled out from this working position.

It is particularly advantageous if the splicing station contains splicing clamps which can be pressed onto the label band and can be moved along a predetermined area of the transport path. In this way, it is ensured that the pressure applied for the strengthening of the splicing connection can be applied continuously and uniformly over the entire splicing point without labels being pressed on in any manner. One particularly simple possibility for moving the splicing clamps is a joint entrainment through the movement of the label band. For this purpose, the splicing clamps are displaceable along a guide unit.

In order to simplify the insertion of the trailing, or new, label band, the splicing station contains a suction holding device for that purpose.

The division of the transport path into two equally valid branches in front of the splicing station, each branch of which is provided with at least one label-removing device but each of which can, however, also contain a separating device, simplifies the operation of the device and reduces the type and the number of movements that are to be carried out by the label bands.

The control of the device in accordance with the disclosure is particularly simple and requires, in principle, only one sensor that determines the position of a label in the transport path, preferably behind the splicing station. If this position is known, then it can be determined precisely, from the known distance from the sensor to the separating device and/or to the label-removing device, and from the known dimensions of the label band—that is to say, in particular, the dimension of the labels in the direction of transport as well as the distance between the labels on the label band—when cutting can be carried out and where cutting has been carried out, or if a label is located in a position in which it can be removed from the label band, as the case may be. By means of this sensor, furthermore, the size of the gap caused by the splicing point between the label positioned directly in front of the splicing point and the label positioned directly behind the splicing point can be determined, which facts can be used, if necessary, for the control of later labeling machines or the like.

Furthermore, a second sensor, in the broadest sense of the term, by means of which it can be determined when the forward label band used is used, can also be provided.

In order to form a defined reference edge on the splicing point, the trailing label band should also be cut. Since, in the device in accordance with the disclosure and the process in accordance with the disclosure, the beginning of the trailing label band does not have to be label-free, this can be carried out in the usually very narrow intermediate space between two labels, so that the beginning edge that thereby arises is in a completely optimal register alignment with the labels. An excessively great gap between the labels in front of and behind the splicing point is also avoided this way.

BRIEF DESCRIPTION OF THE DISCLOSURE

Figure 2:
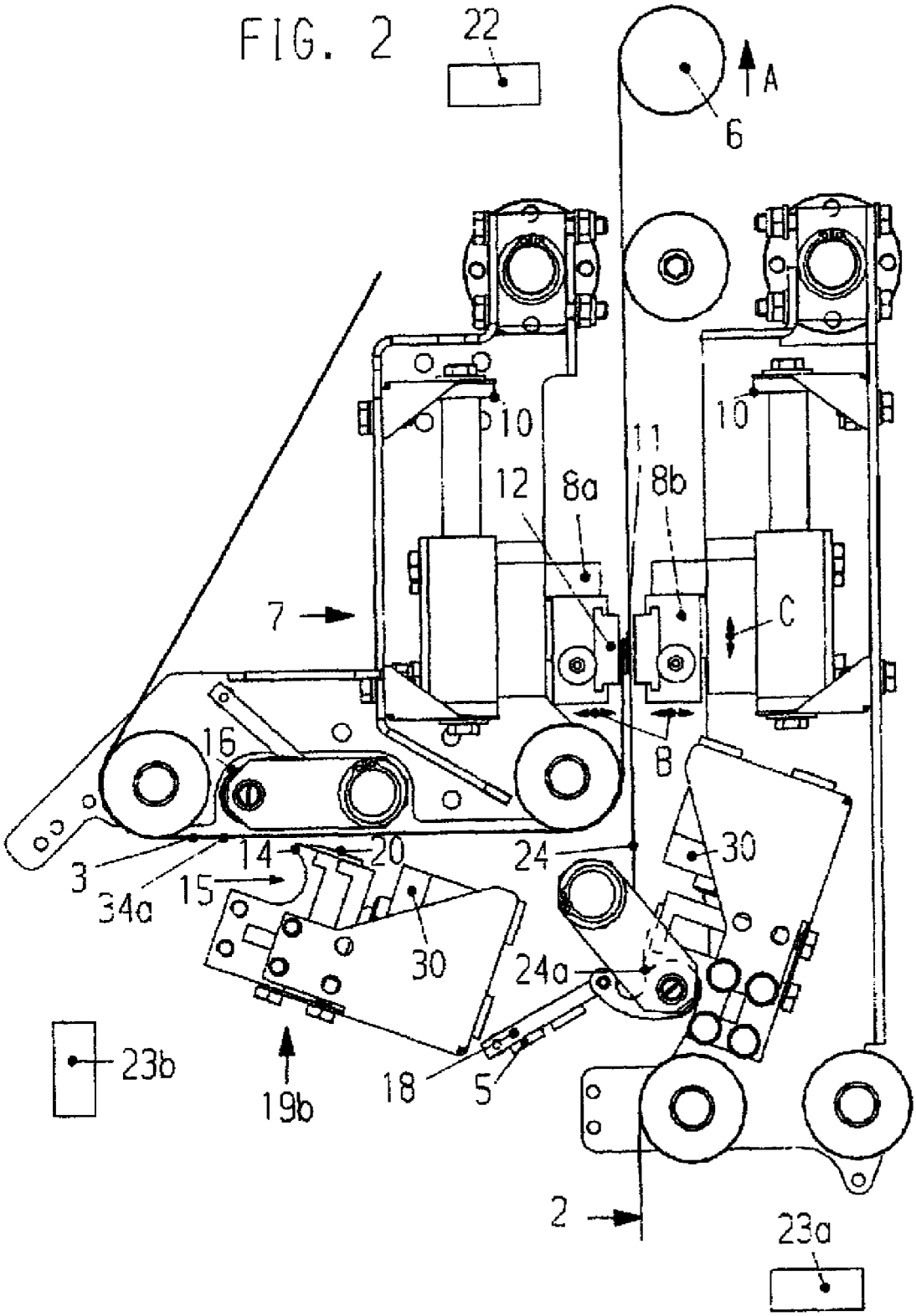

One example of implementation of the disclosure is illustrated in greater detail in the following by means of the diagrams. These depict the following:

FIG. 1: A schematic view from above of a device in accordance with the disclosure during normal conveyance operation; and:

FIG. 2: A view from above of the device in accordance with FIG. 1, shortly before the splicing.

DETAILED DESCRIPTION OF THE DISCLOSURE

A device 1 in accordance with the disclosure for the splicing of label bands 2 and 3 is provided by FIGS. 1 and 2. The label bands 2, 3 are of the conventional type, and each one contains a support band 4, to one side of which self-adhering labels 5, which are of the same size and have uniform distances, and which can be detached from the support band 4 in a labeling machine, are preferably applied. The label bands 2, 3 are identical in their configuration. Furthermore, for the simplification of the depiction, labels 5 are only shown on one portion of the label band 2, even though both label bands 2, 3 are provided with the labels 5.

The size of the labels 5 and their distance from the support band 4 of both label bands 2, 3 are known and can be preset by a control device, which is not depicted.

Both label bands 2, 3 are removed from a stock, such as from a stock roll, for example, which is positioned on a conventional rotating disk or the like, not depicted, and conveyed through the device 1 with the help of a conveying device 6 which is, in the example of implementation depicted, a band roller driven in the direction of transport "A".

The device 1 contains a splicing station 7 in which, if a label band proceeding in the direction of transport "A", in this case, the label band 2, reaches its end, then it is joined to a second, new, trailing label band, in this case, the label band 3, so that the device 1 leaves a continuous succession of labels.

The splicing station 7 is designed for the splicing of the label bands 2, 3 during their transport movement in the direction "A". For this purpose, the splicing station contains a first splicing clamp 8-*a* and a second splicing clamp 8-*b*. The splicing clamps 8-*a*, 8-*b* are mutually positioned on both sides of the label band whereby, in the example of implementation depicted, the splicing clamp 8-*a* is oriented towards the label side of the support 4, and the splicing clamp 8-*b* is oriented towards the reverse side of the support carrier 4. The splicing clamps 8-*a*, 8-*b* are normally positioned in relation to one another at a distance "a" which permits an unimpeded flowing through of a complete label band and is caused by a bulge, such as caused by a following splicing point, which will be discussed later. The splicing clamps 8-*a*, 8-*b* are, however, movable towards one another and away from one another in the direction of the double arrow "B", so that the distance "a" is reduced and the splicing clamps 8-*a*, 8-*b* can exert a pressure on the label band that is positioned between them.

The splicing clamps 8-*a*, 8-*b* are, furthermore, movable along the double arrow "C" in parallel to the direction of transport "A", so that they can move together with the label band and at the same speed.

The splicing clamps 8-*a*, 8-*b* are guided during their movement along the double arrow "C" by a guide unit 9-*a*, 9-*b* which, in the present example of implementation, is a guidance system with recirculating ball bearings. In particular, each guide unit 9-*a*, 9-*b* contains a guide bar to which specific forward- and backward end stops 10 are assigned, so that the splicing clamps 8-*a*, 8-*b* are displaceable between the end stops 10 of the ball bearings.

The pressing movement "B" of the splicing clamps 8-*a*, 8-*b* is brought about by suitable means, such as pneumatic devices, for example. The movement along the double arrow "C" is brought about by the label band moving in the direction of transport "A", whereby the splicing clamps 8-*a*, 8-*b* are pressed against the label band, symmetrically to one another and from both sides, with a force that is sufficient for the splicing clamps 8-*a*, 8-*b* to be jointly entrained by the label band.

Each of the splicing clamps 8-*a*, 8-*b* is provided with a holding device 12, by means of which a trailing label band 3 can be kept in a position of readiness. In order to provide an overlapping splicing with the help of an adhesive tape 11 adhering on both sides, this is prepared in an appropriate manner and is attached, at a defined distance from a defined beginning edge of the trailing label band 3, to the reverse side of the support carrier 4 oriented away from the labels 5. The trailing label band 3 is then inserted into the splicing station 7 and is attached by the label side to the holding device 12 on the coordinated splicing clamps 8-*a*, 8-*b*. In the present example of implementation, the holding device is configured as a vacuum strip. In this position, the trailing label band 3 remains in the readiness position until a splicing process is necessary.

A first branch W1 and a second branch W2 converge together into a joint transport path W3 in front of the splicing station 7 in the direction of transport. The splicing station 7 is located in the joint transport path W3. A label-removing device 13-*a* or 13-*b*, respectively, which are suitably configured in an identical manner, so that only the label-removing device 13-*a* that is active in FIGS. 1 and 2 is described in the following, are each provided in the transport paths W1 and W2. The label-removing device 13-*a* contains a deflector edge 14 for a sharp deflection of the direction of transport of the label band. The deflector edge 14 borders a guide recess 15 which is, in the present example of implementation, configured as partially circular, preferably semi-circular, for the accommodation of a pressure roller 16. The deflector edge 14 is thereby located closer to the label band than the guide recess 15, and is oriented opposite to the direction of transport "A". The deflector edge 14 and the guide recess 15 are located at a fixed, known point in the transport path W1, W2, and on the reverse side of the support carrier 4 that is oriented away from the labels 5.

A pressing device such as a pressure roller 16 is supported rotatably on the swiveling lever 17, and is located on the label side of the support carrier 4. The swiveling label 17 can be moved in the direction of the arrow "D" in such a manner that the pressure roller 16 can be pressed against the label side of the label band 2 and jointly entrain the label band into the guide recess 15, as depicted in FIG. 2. If the conveyance of the label band 2 is now continued in the direction "A", then the labels 5 are detached upon passing over the deflector edge 14 of the support carrier 4, as depicted in FIG. 2.

For a controlled disposal of the detached labels 5, a reception surface 18 can, simultaneously with the swiveling lever 17, be swiveled into a position in which the detached labels accumulate on the reception surface 18 and can then be removed over the reception surface 18. The reception surface 18 is preferably provided on a plate which is articulated with the swiveling lever 17 by means of an appropriate lever mechanism, which ensures that the reception surface 18 is jointly entrained upon the swiveling of the swiveling lever 17 into the accommodation position that is desired.

In addition, a separating device 19-*a* or 19-*b*, respectively, is assigned to each of the two branches W1, W2 of the transport path W. The separating devices 19-*a* and 19-*b* are, in turn, configured in an identical manner, so that only the separating device 19-*a* of the transport path branch W1 is described in the following.

The separating device 19-*a* forms a joint unit with the label-removing device 13-*a*. The separating device 19-*a* contains a blade 20 which is positioned on a blade block 21 and can be moved in the direction of the double arrow "E". The movement of the blade block 21, and consequently of the blade 20, is preferably carried out by pneumatic means.

The blade 20 is positioned in such a manner that it cuts a label band directly on the deflector edge 14. In the example of implementation depicted, the blade is positioned on the side oriented towards the guidance recess 15 and is, consequently, positioned on the side of the deflector edge 14 oriented towards the label band and is, upon its movement along the arrow "E", placed against the deflector edge 14 and guided through it. The blade 20 is movable in such a manner that it is normally moved back in the direction of transport "A" behind the deflector edge 14, and is only moved forward for the cutting by the deflector edge 14.

The device 1 contains a control device, not depicted, which is connected with a first sensor 22. The first sensor 22 can be any suitable device by means of which the position of a label 5 on the support carrier 4 can be determined. The sensor 22 is positioned at a defined position in the transport path, preferably in the transport path W3 and in the direction of transport "A" behind the splicing station 7. The sensor 22 can, for example, contain a device by means of which an edge of a label 5, which proceeds transversely to the direction of transport "A", can be determined. Furthermore, the parameters of the label band and of the device, such as, for example, the size of the label 5, the distance "a" from the support carrier 4, the speed, etc., for example, can be input into the control. Furthermore, the position of the sensor 22 and the position of the splicing station 7, and particularly the position of the splicing clamps 8-*a*, 8-*b*, are known to the control device if they are located on the catching unit 10 that has first passed in the direction of transport "A" of the label band. Furthermore, the conveying device knows the position of the deflector edge 14 and the point at which it is cut, which, in the example of implementation depicted, coincides with the position of the deflector edge 14. The positions of the individual components can be determined by means of absolute determinations of position or by means of the determination of the distances from one another.

Furthermore, a second sensor 23 is provided, by means of which the approaching end of a label band that is in use at that time can be determined, for example. The sensor 23 accordingly informs the control device that a splicing process must shortly begin. The sensor 23 also activates the first sensor 22.

The control device can, furthermore, be configured in such a manner that it can intervene in the operation of a following labeling machine or the like, in order to balance out the large gaps that arise during splicing, for example.

In the figures, the device 1 is depicted in a condition in which the first label band 2 is conveyed through the transport paths W1 and W3 to a labeling device, not depicted, and is used there for the labeling of containers. In this condition, the splicing clamps 8-*a*, 8-*b* have a sufficient distance "a" from one another so that they do not disturb the conveying movement. Furthermore, the pressure roller 16 of the separating device 19-*a* and of the label-removing device 13-*a* are swiveled away out of the transport path W1, so that they do not come into contact with the label band 2. The blade 20 has been removed behind the deflector edge 14.

A second label band, the label band 3, is located in the readiness position. The label band 3 has already been provided with a defined beginning edge, preferably by means of a cut between two successively following labels 5. On the reverse side of the support band 4 oriented away from the labels 5, at a small predetermined distance from the defined beginning edge, the two-sided adhesive strip 11, or any other adhesive material applied, as well as any covering paper that is present, have already been removed, if necessary. Then, the beginning provided with the adhesive strip 11 is inserted into the splicing station 7 and, specifically so, in such a manner that the label 5 is oriented towards the corresponding splicing clamp 8-*a*. The holding device, such as the vacuum strip 12, for example, has been activated, so that the beginning of the label band 3 is fixed at the defined point. The label band 3 is guided tightly over the transport path W2.

If the sensor 23 now detects the approaching end of the label band 2, then a signal is produced. The sensor 22 is activated and seeks a clearly defined point on the label band 2, such as the edge of a label, for example. If this is found, then the point in time at which a label is located in a position favorable for the detachment in relation to the deflector edge 14 of the label-removing device 13-*a* is determined from the known parameters of the label band 2 and the device 1. The swiveling lever 17, along with the pressure roller 16, is, during the entrainment of the label band 2, swiveled into the accommodation depression, as depicted in FIG. 2. At the same time, the reception surface 18 is brought into the accommodation position. The label band 2 now proceeds between the pressure roller 16 and the recess 15 and undergoes an abrupt change of direction at the deflector edge 14, as the result of which the labels can be detached. The inward swiveling is maintained long enough until at least a portion of a label 5 has been detached. If this has happened, then the blade block 21 is activated and cuts through the support carrier 4 behind the point at which the label or the portion of the label, as the case may be, was detached. The pressure roller 16 thereby remains swiveled in, so that a smooth, clean cut is ensured. In this way, a label-free splicing area 24, which is defined by a defined cut edge 24-*a*, is formed on the label band 2. The splicing area 24, along with the border edge 24-*a*, now enters into the splicing station 7. The point in time at which this occurs and at which the splicing area 24 is located in the correct splicing position is determined by the control by means of the parameters of the label band and of the device.

If the splicing area 24 is located in the splicing station 7 and, specifically so, in such a manner that the border edge 24-*a* is still located behind the adhesive strip 11 in the direction of transport "A", then the splicing clamps 8-*a*, 8-*b* are moved towards one another in the direction of the arrow "B", whereby both splicing clamps 8-*a*, 8-*b* are moved until the distance "a" has been eliminated. The splicing clamps 8-*a*, 8-*b* consequently press the splicing area 24 and the adhesive strip 11 towards one another. The pressing force of the splicing clamps 8-*a*, 8-*b* is set in such a manner that, on the one hand, a good connection between the label bands 2 and 3 is achieved and, on the other hand, enough friction is produced that the label band moving in the direction of transport "A" jointly entrains both splicing clamps 8-*a*, 8-*b* in the direction of the arrow "C". Upon or shortly before reaching the catching unit 10 at the top in FIG. 2, the splicing clamps 8-*a*, 8-*b* move apart from one another again and release the splicing point.

The gap that was caused by the splicing point can be subsequently determined by the sensor 22—that is to say, it can be determined whether the distance between the last label in front of the splicing point and the first label after the splicing point is greater than normal. If that is the case, then the possibility of balancing the labeling machine internally to the device can be utilized, or the corresponding speeds can be adjusted in such a manner that a continuous labeling can be achieved without any downtime.

The label band 3 is now conveyed to production as a forward label band. In the meantime, an additional label band can be brought into the position of readiness over the transport path W-1. Since the adhesive tape 11 must thereby be applied to the label side of the support carrier 4, at least one label is removed manually, and a beginning edge for the formation of a splicing area is cut in the interval for the next label.

If the sensor 23-*b* now reports the approach of the end of the label band 3 on the conveying branch W2, then the sensor 22 is activated in the manner already described, and the pressure roller 16 is swiveled into the guide recess of the removing- and separating device 13-*b*, 19-*b* as soon as a gap is located between two successively following labels 5 on the label band 3 on the deflector edge 14. At the same time, the blade 20 of the separating device 19-*b* is activated and cuts through the label band 3 in order to form a defined end edge between two labels 5. If it is computed that the end edge is approaching the splicing area in the area of the splicing station 7, then the splicing clamps 8-*a*, 8-*b* are moved in order to press against one another in the way that has already been described above.

A special process for splicing is described in the following by means of practical instructions:

1. Place the label roll on the foil disk of the dispenser.
2. Cut through the beginning of the band of the label roll on the cutting surface in the gap between the 1st and the 2nd label.
3. Cut the special adhesive tape 11 to length (approx. 2 mm shorter than the width of the label band).
4. Adhere the adhesive strip 11 to the reverse side of the label band 3 at approx. 1-2 mm distance from the cut edge.
5. Open the left side of the adhesion unit, considered in the direction of motion of the label 5.
6. Remove and dispose of the covering layer of the adhesive tape 11.
7. Place the beginning of the band thus prepared on the vacuum suction strip 12 in an accurately positioned manner.
8. Close and lock the adhesive bonding again.
9. Rotate the label roll back long enough until the label band has been tightened free of loops.
10. Set the selection switch on "roll prepared" and acknowledge.

The new label roll is now in the waiting position until the "production roll" has been applied.

11. The sensor 23 recognizes the absolute end of the band.
12. The sensor 22 receives a signal from the sensor 23.
13. The sensor 22 is activated and waits for the next "flank" (caused by the label 5 moving past).
14. A parameterized value, which is dependent on the label, ensures that the beginning of the label 5, which is located precisely on the dispensing edge 14, has securely (3-5 min.) passed the dispensing edge 14.
15. If this value has been achieved, then the swiveling lever 17 becomes active.
16. The rotatably supported roll 16 presses the label band 5 into the recess.
17. The reverse side of the support band 4 is pressed with the roller 16 against the recess 15.
18. A tension is consequently produced in the support band 4.
19. The label 5, the beginning of which has already passed the dispenser edge 14, still remains on the support band 4.
20. The next following label 5, however, is completely or partially moved away on the plate 18 swiveling jointly inwardly.
21. If a label-free support band length of approx. 40 mm has been achieved (through a parameterized value), then the cutting process is initiated.
22. The pneumatic cylinder 30 of the separating device 19-*a* moves out and cuts through the support band 4 by means of a blade 20 directly at the dispensing edge 14 where the tension in the support band 4 is the greatest.

23. The end of the band, which is now cleanly cut, is moved to the splicing station by means of the band drive unit (Dunker motor dispensing assembly) in a precisely-positioned manner.

24. If the Dunker motor reports "adhesion position attained" through the SPS, then both of the splicing clamps 8-*a*, 8-*b* are activated.

25. The clamps 8-*a*, 8-*b* simultaneously move outwardly and press the end of the band of the "still in use" production band together with the beginning of the "new" label roll.

26. Both of the splicing clamps 8-*a*, 8-*b* are supported in a displaceable manner in the direction of the band "A" and are jointly entrained by means of the current label band.

27. After a parameterized interval, both of the clamps 8-*a*, 8-*b* again move inwardly, release the adhesion point, and are brought back into their starting position by means of compression springs.

28. The production is now carried out by the "new" label roll.

29. The operator can now open the right side of the adhesion station, considered in the direction of movement of the label band.

30. Remove and dispose of the dispensed labels 5 and the label remnants cut off, as well as the core of the label roll that has been used up.

31. Place a new label roll on the foil disk that has become free.

32. Remove and dispose of the first label 5 of the support band 4.

33. Cut off the support band 4 on the cutting surface cleanly and at a suitable angle approx. 30 mm in front of the beginning of the next label 5.

34. Cut the special adhesive tape 11 to length (approx. 2 mm shorter than the width of the label band).

35. Attach the adhesive tape 11 at the distance of approx. 5 mm from the next label 5.

36. Remove and dispose of the covering layer of the adhesive tape 11.

37. Attach the beginning of the band thus prepared positioned precisely on the vacuum suction strip 12.

38. Close and lock the adhesive bonding again.

39. Turn the label roll back long enough until the label band has been tightened free of loops.

40. Set the selection switch on "roll prepared" and acknowledge.

The "new label roll" is now in the waiting position until the "production roll" has been used up.

41. The sensor 23 recognizes the absolute end of the band.

42. The sensor 22 receives a signal from the sensor 23.

43. The sensor 22 is activated and waits for the next "flank" (caused by the passing label).

44. A parameterized value, which is dependent on the label, ensures that a gap is positioned in the labels by the blade 20 of the separating unit.

45. If this value has been achieved, then the separating unit becomes active.

46. The cylinder 30 moves outwardly and first of all presses the label band 3 against a block by means of a spring-mounted element and subsequently (in the same movement) cuts through the support band in the labels gap.

47. The end of the band, which is now cleanly cut, is moved by means of the band drive unit 6 (Dunker motor dispensing assembly) to the splicing station 7 in a precisely-positioned manner.

48. If the Dunker motor reports, "adhesion position achieved" through the SPS, then both of the clamps 8-*a*, 8-*b* are activated.

49. The clamps 8-*a*, 8-*b* simultaneously move outwardly and press the end of the band of the "still in use" production band, together with the beginning of the "new" label roll.

50. Both of the clamps 8-*a*, 8-*b* are supported displaceably in the direction of the band "A" and are jointly entrained by means of the current label band.

51. After a parameterized interval, both of clamps 8-*a*, 8-*b* move inwardly again, release the adhesion point, and are brought back into their starting position by means of compression springs.

52. The production is now carried out by the "new" label roll.

53. Remove and dispose of the separated label remnants.

54. Upon the placement of a new label roll, the sequence described is repeated.

As a variation from the example of implementation described and depicted, the splicing station can also be provided with driven entraining clamping devices, such as a conveyor belt or the like, for example. Rolls or similar elements can be used instead of the clamps. The label-removing device provided in the second conveying branch can be omitted if it is ensured, in some other way, that the separating device can carry out a clean cut at a defined point.

The invention claimed is:

1. A device for the splicing of label bands, comprising:

a conveying device for moving a first forward label band and a second trailing label band forward along a transport path (W);

a splicing station for exerting a splicing pressure during the conveying; and a label-removing device for the formation of a splicing area through the removal of at least a portion of a label from the trailing end of the forward label band, said label-removing device disposed in front of the splicing station in a direction of transport.

2. A device in accordance with claim 1, wherein the label-removing device has a deflector edge that borders a guide recess for the label band, and further comprising a pressing device for pressing one of the first forward label band and the second trailing label band into the guide recess.

3. A device in accordance with claim 1, and a separating device for producing an end edge of the first forward label band defined in the transport path (W), the separating device disposed in front of the splicing station in the direction of transport (A) in a trailing end of the splicing area.

4. A device in accordance with claim 3, wherein the separating device has a deflector edge that borders a guide recess for the label band, and further comprising a pressing device for pressing one of the first forward label band and the second trailing label band into the guide recess.

5. A device in accordance with claim 4, wherein the deflector edge is coordinated with both the separating device and the label-removing device.

6. A device in accordance with claim 4 wherein the pressing device comprises a pressure roller supported on a swiveling lever.

7. A device in accordance with claim 6, wherein the label-removing device has a reception surface for the removed label.

8. A device in accordance with claim 7, wherein the reception surface is connected with the swiveling lever in an entrainable manner.

9. A device in accordance with claim 1, wherein the splicing station has a pair of splicing clamps that can be pressed against the first leading and second trailing label bands, the splicing clamps being movable along the direction of transport over a predetermined area of the transport path.

10. A device in accordance with claim 9, wherein each of the splicing clamps is displaceable along a respective guide unit along the direction of transport.

11. The device in accordance with claim 9, wherein each of the splicing clamps is displaceable in a direction (B) perpendicular to the direction of transport.

12. A device in accordance with claim 9, wherein the splicing station includes a holding device.

13. A device in accordance with claim 12, wherein the holding device is a suction holding device for the trailing label band.

14. A device in accordance with claim 1, wherein the transport path (W) has a first and a second branch (W1, W2) in front of the splicing station, wherein each of the branches (W1, W2) is provided with at least one separating device, and each of the branches (W1, W2) is configured for the alternating forward movement of the first forward label band and the second trailing label band.

15. A device in accordance with claim 1, further comprising a first sensor for the determination of the position of a label, the first sensor being disposed downstream of the splicing station.

16. A device in accordance with claim 15, further comprising a second sensor for the determination of the condition of depletion of the forward label band.

17. A process for the splicing of label bands, comprising:

providing a splicing station;

providing a forward, first label band having a plurality of labels thereon;

advancing the first label band along a transport path;

producing an end edge of the forward label band in the transport path;

providing a trailing, second label band having a plurality of labels thereon;

advancing the second label band along the transport path;

after producing the end edge of the forward label band and while advancing the first and second label bands along the transport path, splicing the second label band to the first label band at the splicing station; and before the splicing and while advancing the forward, first and trailing, second label bands along the transport path, producing a label-free splicing area on the forward, first label band by removing at least a portion of a label from the forward, first label band.

18. A process in accordance with claim 17, and before the removal of the label, determining the position of at least one comparison label downstream of the splicing station and using that determined position to control the removal.

19. A process in accordance with claim 17, and cutting the forward label band before the splicing.

20. A process in accordance with claim 19 and, before the cutting of the forward label band, determining the position of at least one comparison label downstream of the splicing station and using that determined position to control the cutting.

21. A process in accordance with claim 17, and, during the splicing, exerting a contact pressure which is maintained continuously over a partial section of the transport path.

22. A process in accordance with claim 17, further comprising:

cutting the trailing label band between two labels thereon; and using a beginning edge exposed by said cutting as a reference edge upon insertion of the trailing label band into the splicing station.

23. A process for the splicing of label bands, comprising:

providing a splicing station;

providing a forward, first label band having a plurality of labels thereon;

advancing the first label band along a transport path;

producing an end edge of the forward label band in the transport path;

providing a trailing, second label band having a plurality of labels thereon;

advancing the second label band along the transport path;

after producing the end edge of the forward label band and while advancing the first and second label bands along the transport path, splicing the second label band to the first label band at the splicing station; and after the splicing, determining the distance of the labels positioned immediately before and immediately after the splicing area and using the determined distance to control a subsequent labeling process.

* * * * *